US008091717B2

(12) United States Patent
Sprave et al.

(10) Patent No.: US 8,091,717 B2
(45) Date of Patent: Jan. 10, 2012

(54) AUTOMATICALLY FOLDABLE COUPLER

(75) Inventors: Rainer Sprave, Goslar (DE); Siegfried Kobert, Holle (DE); Dietmar Busch, Laatzen-Rethen (DE); Henning Wiegand, Wolfenbüttel (DE)

(73) Assignee: Voith Patent GmbH, Heidenheim (DE)

( * ) Notice: Subject to any disclaimer, the term of this patent is extended or adjusted under 35 U.S.C. 154(b) by 629 days.

(21) Appl. No.: 12/081,756

(22) Filed: Apr. 21, 2008

(65) Prior Publication Data

US 2008/0264891 A1 Oct. 30, 2008

(30) Foreign Application Priority Data

Apr. 25, 2007 (EP) ..... 07106914

(51) Int. Cl.
*B61G 7/00* (2006.01)

(52) U.S. Cl. ..... 213/20; 213/18

(58) Field of Classification Search ..... 213/4, 12, 213/18–21, 74

See application file for complete search history.

(56) References Cited

U.S. PATENT DOCUMENTS

| | | | | |
|---|---|---|---|---|
| 5,472,104 | A * | 12/1995 | Domsgen | 213/4 |
| 6,805,251 | B2 * | 10/2004 | Radewagen et al. | 213/20 |
| 7,055,705 | B2 * | 6/2006 | Sprave | 213/20 |
| 2005/0145591 | A1 * | 7/2005 | Mattschull et al. | 213/75 R |

* cited by examiner

*Primary Examiner* — Joe Morano, IV
*Assistant Examiner* — R. J. McCarry, Jr.
(74) *Attorney, Agent, or Firm* — Jean C. Edwards, Esq.; Edwards Neils PLLC

(57) ABSTRACT

A central buffer coupling having a coupling head, a coupling shaft and a bearing block attachable to the front face of a car body. The coupling shaft includes a front shaft component supporting the coupling head and a rear shaft component coupled to the bearing block so as to be horizontally pivotable which are pivotable in the horizontal plane relative one another about a rotational axis defined by a connecting pin, and the central buffer coupling further includes a pivoting mechanism to pivot the front shaft component relative the rear shaft component. The pivoting mechanism includes a slotted gate fixedly attached to one of the two shaft components and having a sliding guide, a cam disc rotatably mounted about the rotational axis defined by the connecting pin and having a cam disc guide, and a bolt connecting the one to the other of the two shaft components.

18 Claims, 6 Drawing Sheets

AUTOMATICALLY FOLDABLE COUPLER

BACKGROUND OF THE INVENTION

The present invention relates to a central buffer coupling having a coupling head, a coupling shaft and a bearing block attachable to the front face of a car body, wherein the coupling shaft comprises a front shaft component supporting the coupling head and a rear shaft component coupled to the bearing block so as to be horizontally pivotable which are pivotable in the horizontal plane relative one another about an axis of rotation defined by a connecting pin, and wherein the central buffer coupling further comprises a pivoting mechanism for pivoting the front shaft component relative the rear shaft component.

The principle behind an articulated coupling of this type is widely known in the prior art, in particular in rail vehicle technology. For example, the EP 0 640 519 A1 printed publication describes a central buffer coupling for rail vehicles comprising a two-part coupling shaft formed from a front shaft component supporting the coupling head and a rear shaft component coupled to the frame of the rail vehicle so as to be horizontally pivotable, its two shaft components connected to one another by a vertical connecting pin.

Articulated couplings designed with a coupling shaft of two or more parts so that the coupling head can, for example, be swiveled into the vehicle profile when not in use usually utilize a pivoting mechanism to pivot the coupling head inwardly and outwardly and to unlock and lock the shaft components in the inward or outward pivoted state of the coupling shaft, said mechanism normally comprising at least one lifting magnet or similar device to realize the unlocking and locking, and at least one linear drive or similar device additionally thereto to realize the inward and outward pivoting process. It is thus necessary to provide such central buffer couplings with various mountings, etc., in order to secure the drives of the pivoting mechanism. This necessity leads on the one hand to a relatively complex design for the central buffer coupling and, on the other, to an increase in the coupling's weight.

The articulated couplings normally used in the prior art additionally require a resultant relatively complex design to the pivoting mechanism when manufacturing the central buffer coupling, respectively a plurality of additional machining steps when fitting the individual components of same, making the mounting of the pivotable central buffer couplings known to date more difficult.

SUMMARY OF THE INVENTION

Based on this problem as set forth, the present invention now addresses the task of simplifying the overall structure of a central buffer coupling of the type cited at the outset, thus the structure of a central buffer coupling which makes use of a multi-part coupling shaft to pivot its coupling head into the vehicle profile and pivot it out into the coupling plane. In particular, a pivoting mechanism is to be specified which does away with the need for two drives operating individually of one another to realize the locking and unlocking and the inward and outward pivoting.

This task is solved in accordance with the invention by a central buffer coupling of the type cited at the outset having the pivoting mechanism comprise a slotted gate fixedly attached to one of the two shaft components, for example the front shaft component, and having a sliding guide, a cam disc rotatably mounted about a rotational axis defined by the connecting pin and having a cam disc guide, as well as a bolt connecting the one to the other of the two shaft components, for example to the rear shaft component, the first end of which is received in a bolt guide in the sliding guide and its second end in the bolt guide in the cam disc guide in each case such that upon rotation of the cam disc about the rotational axis, at least a portion of the resulting torque can be transmitted from the cam disc to the slotted gate via the bolt, whereby each rotational position of the cam disc corresponds to a specific position of the first end of the bolt guide of the bolt delegated to the slotted gate in the sliding guide.

The advantages attainable with the inventive solution are obvious. Compared to the previous solutions, utilizing a pivoting mechanism consisting of a slotted gate and a cam disc interacting by means of a bolt does away with the need for a lifting magnet for locking and unlocking as well as the linear drive needed for the inward and outward buckling. Since the solution proposed here has one and the same mechanism fulfilling both the function of locking and unlocking the two shaft components comprising the coupling shaft as well as the function of effecting the inward and outward buckling of the coupling shaft, the pivoting mechanism of the central buffer coupling can be of overall simpler configuration. The pivoting mechanism is in particular characterized by its compact design, which allows a space-saving integration into the inventive articulated coupling. Since only one single drive is required to realize the locking and unlocking and to realize the inward and outward pivoting when making use of the optimized pivoting mechanism, the number of components in the central buffer coupling according to the invention can be reduced, which is of especially advantageous benefit to the coupling's weight.

With regard to the pivoting mechanism, it is in particular provided for the torque exerted on the cam disc about the rotational axis defined by the connecting pin to be transmitted to the slotted gate via the bolt, since the bolt engages on the one hand in the cam disc guide and in the sliding guide on the other. Since the slotted gate is fixed to one of the two shaft components, for example to the front shaft component, and the cam disc to the other of the two shaft components, for example to the rear shaft component, the torque transmitted to the slotted gate upon rotation of the cam disc can be directly used to pivot the two shaft components relative to one another so as to thus realize an inward and outward pivoting of the coupling head attached to the front shaft component, for example into the coupling plane or into the vehicle profile.

The hereto necessary rotation of the cam disc about the rotational axis defined by the connecting pin can be effected in different ways. It is for example conceivable to provide a manually-operated or an electric, pneumatic or hydraulic drive for this purpose. What is essential is that when the coupling shaft is in the outward-pivoted state; i.e. when the two shaft components of the coupling shaft are not pivoted outward relative one another and are positioned on the coupling's longitudinal axis, the force flow to be transmitted by the central buffer coupling in the longitudinal direction of same does not run through the bolt itself, but rather through the connecting pin by means of which the two shaft components of the coupling shaft are pivotably connected together in the horizontal plane.

It is apparent that in contrast to the pivoting mechanisms known in the prior art, a rotation drive can also be used in the proposed solution to pivot the coupling shaft, which further simplifies the design and functioning of the pivoting mechanism.

Advantageous embodiments of the inventive solution are set forth in the subclaims.

One preferred realization of the sliding guide, the cam disc guide respectively, provides for same to be configured as a guiding slot in which the respectively delegated end of the bolt guide of the bolt is received. In other words, this means that when the sliding guide is configured as a guiding slot, the first end of the bolt guide of the bolt associated with the slotted gate is received in the guiding slot such that the bolt is guided in the slotted gate by means of said guide in correspondence with the design of the guiding slot. Conversely, the cam disc guide can also be configured as a guiding slot, whereby the second end of the bolt guide of the bolt delegated to the guide plate is then correspondingly guided in said guiding slot. On the other hand, it is of course also conceivable for the sliding guide and/or the cam disc guide to be configured as a guiding groove in which the respectively delegated end of the bolt guide of the bolt is correspondingly received and guided.

In order to be able to effect an especially easy to realize and nevertheless effective automatic pivoting of the two shaft components of the coupling shaft relative one another, a particularly preferred realization of the inventive solution provides for the pivoting mechanism to further comprise an actuatable drive, preferably actuatable by means of an external control unit, which is disposed on one of the two shaft components, for example on the front shaft component, so as to be substantially immovable relative to said one of the two shaft components and is designed to rotate as needed the cam disc relative the other of the two shaft components, for example the rear shaft component, about the rotational axis defined by the connecting pin. Because this drive is substantially fixed on one of the two shaft components; i.e. immovable relative said shaft component, actuating the drive will rotate the cam disc relative the other of the two shaft components about the rotational axis defined by the connecting pin. In the rotation of the cam disc about the rotational axis thereby effected, at least a portion of the torque exerted by the drive on the cam disc is transmitted from the cam disc to the slotted gate via the bolt, so that a relative pivoting of the two shaft components to one another about the rotational axis defined by the connecting pin is effected in the horizontal plane.

Because each rotational position of the cam disc corresponds to a specific position of the first end of the bolt guide of the bolt delegated to the slotted gate in the sliding guide, it is possible, given the appropriate control of the drive, to pivot the two shaft components relative to one another in a predictable sequence of events. The pivoting mechanism thus assumes the functionality of a gear mechanism, with the torque of the drive being transmitted to the slotted gate via the cam disc and the bolt. Of course it is also conceivable for the pivoting mechanism to comprise, in addition to the actuatable drive, or as an alternative thereto, a manually-operable drive with which the cam disc can be rotated as needed about the rotational axis defined by the connecting pin relative the other of the two shaft components, for example the rear shaft component. A combination of such a manually-operated mechanism and an actuatable drive is then particularly expedient when redundant operation is to be ensured for the pivoting mechanism.

One particularly preferred realization of the latter embodiment in which the pivoting mechanism further comprises an actuatable drive arranged on one of the two shaft components, for example on the front shaft component, and designed to rotate as needed the cam disc about the rotational axis defined by the connecting pin relative to the other of the two shaft components, for example the rear shaft component, provides for the connecting pin defining the rotational axis to extend through the cam disc and be fixedly connected to same. It is for example conceivable for the cam disc and the connecting pin to be of one-piece design as a single component, for instance a single cast part. It is moreover preferred for the drive to be designed to rotate the connecting pin about the rotational axis as needed, in order to thus effect a corresponding rotation of the cam disc about the rotational axis defined by the connecting pin.

It is hereby of course conceivable for the drive axle of the drive to not interact directly with the connecting pin but rather for example via a corresponding gear and/or coupler in order to transmit torque to the connecting pin as needed. It is evident that by employing the slotted gate and the cam disc, which interact by means of the bolt, the drive of the pivoting mechanism does not need to be configured as a linear drive. A conventional rotation motor would instead be suited to realize actuation, said motor initiating the mechanical performance in the pivoting mechanism in the form of rotation.

A particularly preferred realization of the two shaft components connected together by means of the connecting pin provides for both the front shaft component as well as the read shaft component to be configured as a fork, each with two respective fork arms, whereby the two fork arms of the one shaft component, for example the rear shaft component, are at least partly received between the fork arms of the other shaft component, for example the front shaft component, and whereby the cam disc is at least partly received between the two fork arms of the other shaft component. In so doing, the connecting pin should extend through the two fork arms of the other shaft component and be pivotably supported about the rotational axis both in the fork arms of the one shaft component as well as in the fork arms of the other shaft component. This is a preferred realization of the connection between the two shaft components of the coupling shaft in which the pivoting mechanism of the central buffer coupling can be designed to be extremely compact and thus especially space-saving, whereby at the same time the entire pivoting mechanism as a whole can be configured to be extremely non-wearing and easily mounted. Of course, other variations in realizing the connection between the two shaft components of the coupling shaft are also conceivable.

With regard to the sliding guide, it is preferred for said sliding guide to comprise a preferably uniform circular-segmented guiding section which—depending on the position of the first end of the bolt guide of the bolt delegated to the slotted gate within the circular-segmented guiding section—defines the angle of articulation for the front shaft component relative the rear shaft component. In this embodiment, the angle of articulation between the two shaft components thus realized with the pivoting mechanism is defined by the angle enclosed by the circular-segmented guiding section. By correspondingly selecting the angle enclosed by the circular-segmented guiding section, the angle area covered by the two shaft components relative one another in the process of articulation can be pre-set accordingly. It is of course also conceivable for the cam disc guide instead of the sliding guide to exhibit the preferably uniform circular-segmented guiding section.

In order to have not only the two shaft components being able to be pivoted relative to one another with the pivoting mechanism, but also be able to realize a locking and unlocking of the shaft components, for example in the outward or inward pivoted state of the coupling shaft, a preferred further development of the latter embodiment in which for example the sliding guide exhibits a preferably uniform circular-segmented guiding section provides for the bolt to be displaceable preferably along the longitudinal axis of the coupling shaft relative to the other of the two shaft components, for example to the rear shaft component, between a first position, in which the two shaft components cannot be pivoted relative one another, and a second position, in which the two shaft components are pivotable relative to one another. Furthermore, the sliding guide, for example, should exhibit at least one latching section configured on one of the two ends of the circular-segmented guiding section, which blocks or enables access for the first end of the bolt guide of the bolt associated with the slotted gate in the circular-segmented guiding section depending on the respective position of the bolt on the longitudinal axis of the coupling shaft. In this preferred further development of the inventive solution, the sliding guide, for example, thus encompasses the preferably uniform circular-segmented guiding section which specifies the process of articulation of the coupling shaft on the one hand and, on the other, the latching section provided on both ends of the circular-segmented guiding section which serves as a locking system and in which the bolt can be received depending on the rotational position of the cam disc. Specifically, when the bolt is accommodated in one of the two latching sections and thus no longer situated in the circular-segmented section of the slotted gate, a pivoting of the two shaft components relative one another is blocked since the first end of the bolt guide of the bolt delegated to the slotted gate cannot enter into the circular-segmented section specifying the articulation process for the coupling shaft.

On the other hand—based on the afore-described locked state—the appropriate rotation of the cam disc interacting with the bolt via the second end of the bolt guide of the bolt can result in conveying the first end of the bolt guide of the bolt out of the latching section of the sliding guide in the circular-segmented guide section, whereby the coupling shaft passes into the unlocked state and the actual articulation process is enabled for the coupling shaft. To this end, the guide provided in the cam disc of the pivoting mechanism is configured accordingly so that the bolt can be conveyed from the latching section provided in the sliding guide to the circular-segmented guide section provided in the sliding guide (and vice-versa).

A particularly preferred realization of the latter embodiment in which the bolt is displaceable along the longitudinal axis of the coupling shaft relative to the other of the two shaft components, for example the rear shaft component, between a first position and a second position, provides for the bolt to be configured in the other of the two shaft components, for example the rear shaft component, and held in a slot preferably extending in the longitudinal direction of the coupling shaft, whereby the resultant play for the bolt in the direction of the longitudinal axis of the coupling shaft is greater or equal to the length of the latching section of the sliding guide. This realization thus enables the bolt to displace between the first and the second position by an appropriate rotation of the cam disc while the first end of the bolt guide of the bolt, delegated to the sliding guide, can thereby be conveyed from the latching section of the sliding guide into the circular-segmented guide section or vice-versa.

On the other hand, with respect to the cam disc guide, it is particularly preferably provided for same to exhibit a preferably symmetrical, substantially U-shaped or V-shaped design having two limb sections and a crown section situated between the two limb sections, whereby the cam disc guide and the sliding guide interact such that when the bolt is moved between the first and the second position, the first end of the bolt guide of the bolt engages on the one hand in one of the two latching sections of the sliding guide and the second end of the bolt guide of the bolt engages in one of the limb sections of the cam disc guide on the other, and that when the front shaft component is moved relative to the rear shaft component, the first end of the bolt guide of the bolt engages on the one hand in the circular-segmented guide section of the sliding guide and the second end of the bolt guide of the bolt engages on the other in the crown section of the cam disc guide. This represents a particularly easily-realized and yet effective design for the pivoting mechanism. In particular, the respective shape to the guides in the slotted gate on the one hand, and in the cam disc on the other, are designed respective one another such that in top plan view of the two cam disc and slotted gate components of the pivoting mechanism, the respective guides align with one another at exactly one point, whereby the bolt is provided at this common point. It is therefore possible to provide the pivoting mechanism with a type of gearing by means of a suitable shape, for example to the cam disc guide, by means of which the torque generated by the drive of the pivoting mechanism can be transmitted to the two shaft components arranged to be pivotable relative one another. A symmetrical design to the cam disc guide is particularly judicious when the locking and unlocking should follow the same pattern both in the outwardly-pivoted state of the coupling shaft as well as the inwardly-pivoted state of the coupling shaft.

Particularly preferred with the latter-cited embodiment is for the cam disc guide to comprise at least two pivot sections situated in the crown section, whereby the cam disc guide and the sliding guide interact such that when the second end of the bolt guide of the bolt engages in one of the two pivot sections, the first end of the bolt guide of the bolt is displaceable relative the circular-segmented guide section of the sliding guide. Of course, other embodiments of the cam disc guide are also conceivable.

The pivoting mechanism employed in the solution according to the invention can, however, also be realized without the above-described functionality of unlocking and locking the two shaft components to one another. When this functionality is not needed, and instead only the functionality of pivoting the two shaft components relative one another is desired, it is possible to fixedly connect the bolt to the other of the two shaft components, for example the rear shaft component, preferably on the longitudinal axis of the coupling shaft. This embodiment also dispenses with the necessity of the latching section in the guide for the slotted gate.

Lastly provided in a particularly preferred further development of all the embodiments cited above is for the slotted gate to be releasably attached to the one of the two shaft components, for example the front shaft component. This further development allows for a simple exchanging of the slotted gate to enable the corresponding setting of the pivoting range for the coupling shaft. As already indicated above, the circular-segmented guide section provided in the sliding guide, for example, defines the angle of articulation of the front shaft component relative the rear shaft component. Hence, with a simple exchanging of the slotted gate, the circular-segmented guide section interacting with the bolt and thus the angle of articulation of the front shaft component relative the rear shaft component can be changed.

BRIEF DESCRIPTION OF THE DRAWINGS

The following will make reference to the included figures in describing a preferred embodiment of the central buffer coupling according to the invention in greater detail.

Shown are.

DETAILED DESCRIPTION OF THE EXEMPLARY EMBODIMENTS

Figure 1:
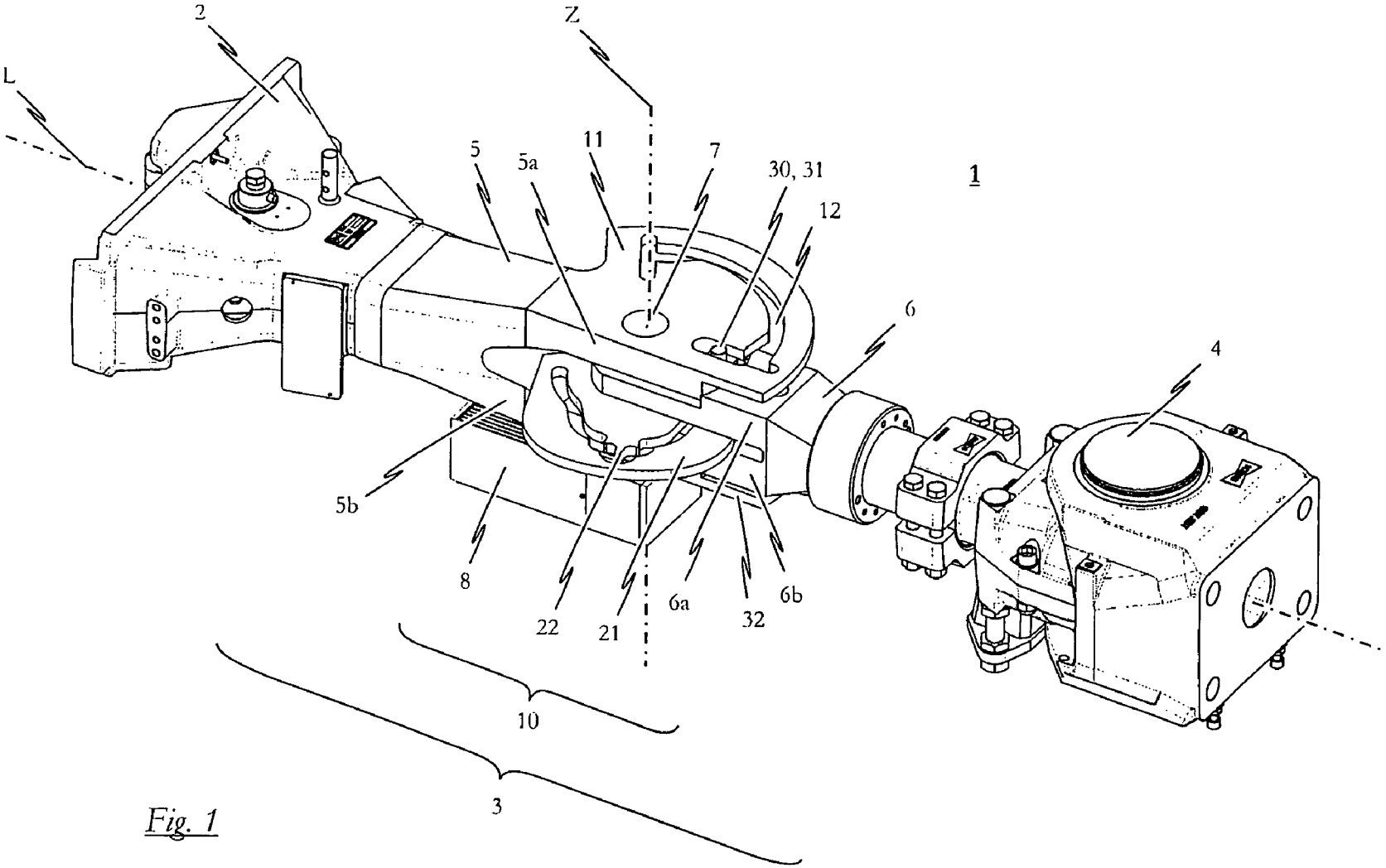
FIG. 1 a perspective view of a preferred embodiment of the inventive central buffer coupling in its outwardly-pivoted state.

FIG. 1 shows a preferred embodiment of the inventive central buffer coupling 1 in its outwardly-pivoted state in a perspective view. The central buffer coupling 1 comprises a coupling head 2, a coupling shaft 3 and a bearing block 4 attachable to the front face of a (not explicitly shown) car body. In detail, the coupling shaft 3 comprises a front shaft component 5 supporting the coupling head 2 and a rear shaft component 6 coupled to the bearing block 4 to be horizontally pivotable. Both shaft components 5, 6 are realized to be pivotable relative one another in the horizontal plane about a rotational axis Z defined by a connecting pin 7 by means of a pivoting mechanism 10.

The pivoting mechanism 10, the design and function of which will be described in greater detail below with particular reference to FIGS. 2*a* to 2*h*, serves to pivot the front shaft component 5 relative the rear shaft component 6.

Figure 3:
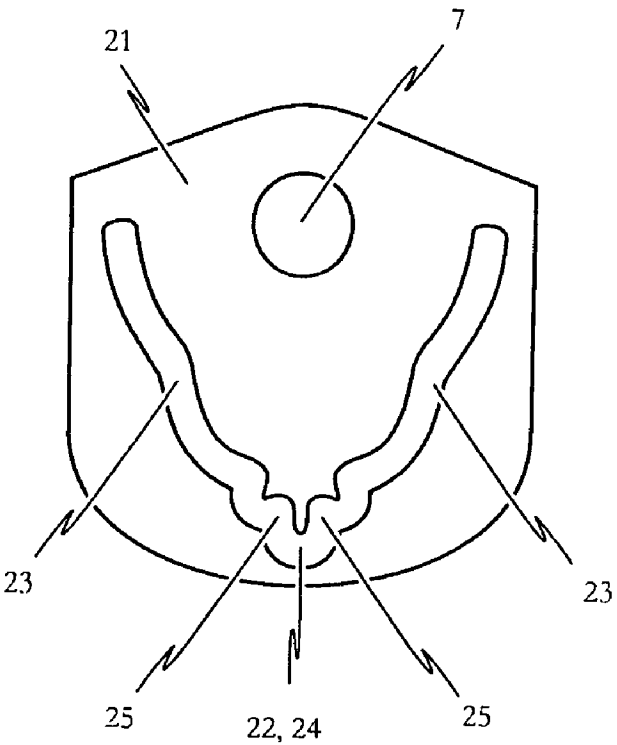
FIG. 3 a top plan view of the cam disc employed in the pivoting mechanism of the preferred embodiment.

The pivoting mechanism 10 consists of a first slotted gate 11 rigidly affixed to the front shaft component 5 and a cam disc 21 rotatably mounted about the rotational axis Z defined by the connecting pin 7. A second slotted gate 32 is—albeit not necessarily—arranged underneath the rear shaft component 6. The first slotted gate 11, which is depicted separately in a top plan view in FIG. 4, comprises a sliding guide 12, in which the first end of the bolt guide 31 of a bolt 30 connected to the rear shaft component 6 is received. On the other hand, the cam disc 21, which is shown in a separate top plan view depiction in FIG. 3, is provided with a guide 22, in which the second end of the bolt guide 31 of bolt 30 is received (not recognizable in the figures). The bolt 30 is thereby disposed with the first end of its bolt guide 31 and the second end of its bolt guide 31 such that upon rotation of the cam disc 21 about rotational axis Z, at least part of the resulting torque can be transmitted from the cam disc 21 to the slotted gate 11 via bolt 30.

As depicted in the figures, in the preferred embodiment of the inventive central buffer coupling 1, both the sliding guide 12 as well as the cam disc guide 22 are respectively configured as guide slots, in which the respectively allocated end of the bolt guide 31 of bolt 30 is received accordingly. Of course it is also conceivable for the respective guides 12, 22 to be respectively configured as guide grooves in which the respective delegated end of the bolt guide 31 of bolt 30 is guided.

In the depicted preferred embodiment of central buffer coupling 1, the pivoting mechanism 10 further comprises an actuatable drive 8, configured here as an externally-actuatable electric rotation motor. Said motor 8 is disposed on the front shaft component 5 so as to be immovable relative said front shaft component 5 and drives as needed the cam disc 21 of the pivoting mechanism 10 via the connecting pin 7, whereby the cam disc 21 is rotated relative to the rear shaft component 6 about the rotational axis Z defined by the connecting pin 7. Specifically, the connecting pin 7 and the cam disc 21 are configured as an integral one-piece component in the depicted embodiment of the central buffer coupling 1, whereby the motor 8 is designed so as to rotate the connecting pin 7 about the rotational axis Z as needed. The connecting pin 7 and the cam disc 21 can, however, also be of two-piece configuration, but then configured to be rotationally-fixed to one another.

Relative the connection of the two shaft components 5, 6, it can be recognized from FIG. 1 that the front shaft component 5 and the rear shaft component 6 are respectively configured as a fork, each with two fork arms 5*a*, 5*b* and 6*a*, 6*b*, whereby the front shaft component 5 partly receives the two fork arms 6*a*, 6*b* of the rear shaft component 6 between its fork arms 5*a*, 5*b*, and whereby the cam disc 21 is likewise partly received between the two fork arms 6*a*, 6*b* of the rear shaft component 6. The connecting pin 7 thereby extends through the two fork arms 6*a*, 6*b* of the rear shaft component 6, whereby said connecting pin 7 is rotatably supported about the rotational axis Z both in the fork arms 5*a*, 5*b* of the front shaft component 5 as well as in the fork arms 6*a*, 6*b* of the rear shaft component 6. As mentioned above, the second slotted gate 32 is disposed underneath the fork arm 6*b*. However, said second slotted gate 32 is not categorically imperative; the (upper) first slotted gate 11 alone will also suffice.

The depicted embodiment of the central buffer coupling 1 comprises a pivoting mechanism 10 which is designed to not only pivot the two shaft components 5, 6 relative each other, but also realize a locking and unlocking of the shaft components 5, 6 into the outwardly-pivoted and inwardly-pivoted state of the coupling shaft 3. For this purpose, the bolt 30 is configured so as to be displaceable along the longitudinal axis L of the coupling shaft 3 relative to the rear shaft component 6 between a first position A, in which the two shaft components 5, 6 are not pivotable relative one another, and a second position B, in which the two shaft components 5, 6 are pivotable relative one another. Although it cannot be explicitly inferred from the enclosed drawings, it is preferable for the bolt 30 of the central buffer coupling 1 to be configured in the rear shaft component 6 and held in a slot (not explicitly shown) preferably extending in the longitudinal direction L of the coupling shaft 3 so as to enable a displacement of bolt 30 between the first position A, in which the two shaft components 5, 6 are not pivotable relative one another, and the second position B, in which the two shaft components are pivotable relative one another.

Before the functioning of the pivoting mechanism 10 employed in the preferred embodiment of the inventive central buffer coupling 1 is described in greater detail with reference to FIGS. 2*a* to 2*f*, reference needs to be made to FIGS. 3 and 4 to describe the cam disc 21 and the slotted gate 11, 32 employed in the pivoting mechanism 10 in greater detail. FIG. 3 hereby shows a top plan view of the cam disc 21 employed in the pivoting mechanism 10 with the cam disc guide 22 configured in said cam disc 21. Said cam disc guide 22 exhibits a symmetrical, substantially U-shape or V-shape with two limb sections 23 and a crown section 24 disposed between said two limb sections 23. Two pivot sections 25 are further provided in the crown section 24. The interaction of the individual sections of the cam disc guide 22 with the sliding guide 12 will be described in greater detail below drawing reference to FIGS. 2*a* to 2*h*.

Figure 4:
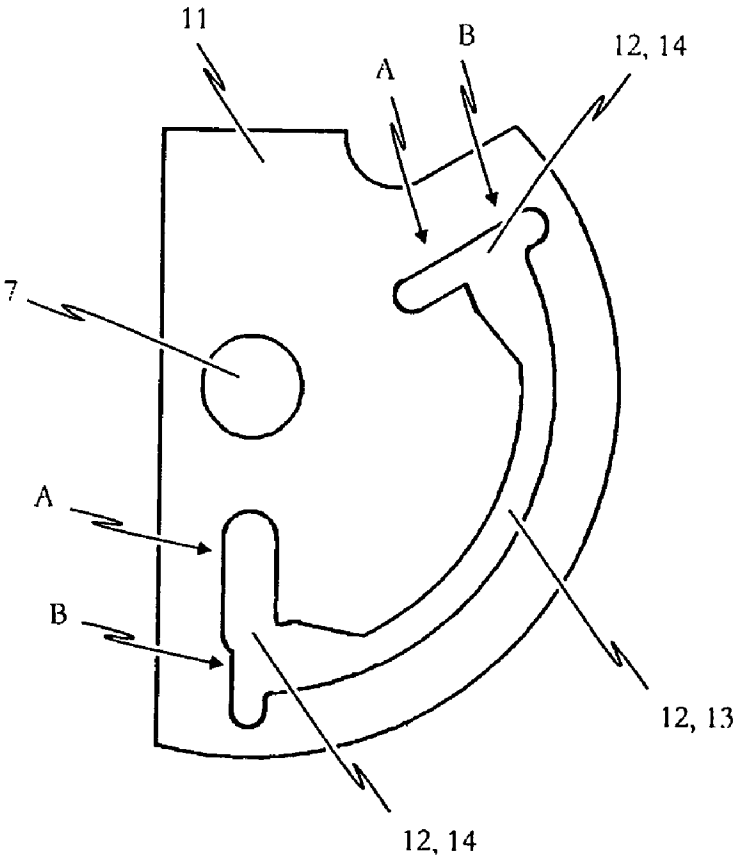
FIG. 4 a top plan view of the slotted gate employed in the pivoting mechanism of the preferred embodiment.

FIG. 4 shows the slotted gate 11 employed in the pivoting mechanism 10 of the preferred embodiment of the inventive central buffer coupling 1 in a top plan view. As shown, the sliding guide 12 comprises a preferably uniform circular-segmented guiding section 13 which—depending on the position of the first end of the bolt guide 31 of the bolt 30 associated with the slotted gate 11 within the circular-segmented guiding section 13—defines the angle of articulation of the front shaft component 5 relative the rear shaft component 6. The sliding guide 12 further comprises at least one latching section 14 configured on one of the two ends of the circular-segmented guiding section 13, which blocks or enables access for the first end of the bolt guide 31 of the bolt 20 delegated to the slotted gate 11 in the circular-segmented guiding section 13 depending on the respective position A, B of the bolt 30 on the longitudinal axis L of the coupling shaft 3.

As can be recognized from the function sequence of the pivoting mechanism 10 as depicted in FIGS. 2*a* to 2*h*, the cam disc guide 22 and the sliding guide 12 interact such that firstly in a case of the bolt 30 being moved between the first and second position A, B, the first end of the bolt guide 31 of bolt 30 engages in one of the two latching sections 14 of the sliding guide 12 on the one hand and the second end of the bolt guide 31 of bolt 30 engages in one of the limb sections 23 of the cam disc guide 22 on the other, and secondly, in a case of the front shaft component 5 being moved relative the rear shaft component 6, the first end of the bolt guide 31 of bolt 30 engages on the one hand in the circular-segmented guiding section 13 of sliding guide 12, and the second end of the bolt guide 31 of bolt 30 engages in the crown section 24 of cam disc guide 22 on the other. Further recognizable from FIGS. 2*a* to 2*h* is that the cam disc guide 22 and the sliding guide 12 interact such that when the second end of the bolt guide 31 of bolt 30 engages in one of the two pivot sections 25 situated in the crown section 24 of the cam disc guide 22, the first end of the bolt guide 31 of bolt 30 is displaceable relative the circular-segmented guiding section 13 of sliding guide 12.

Figure 2B:
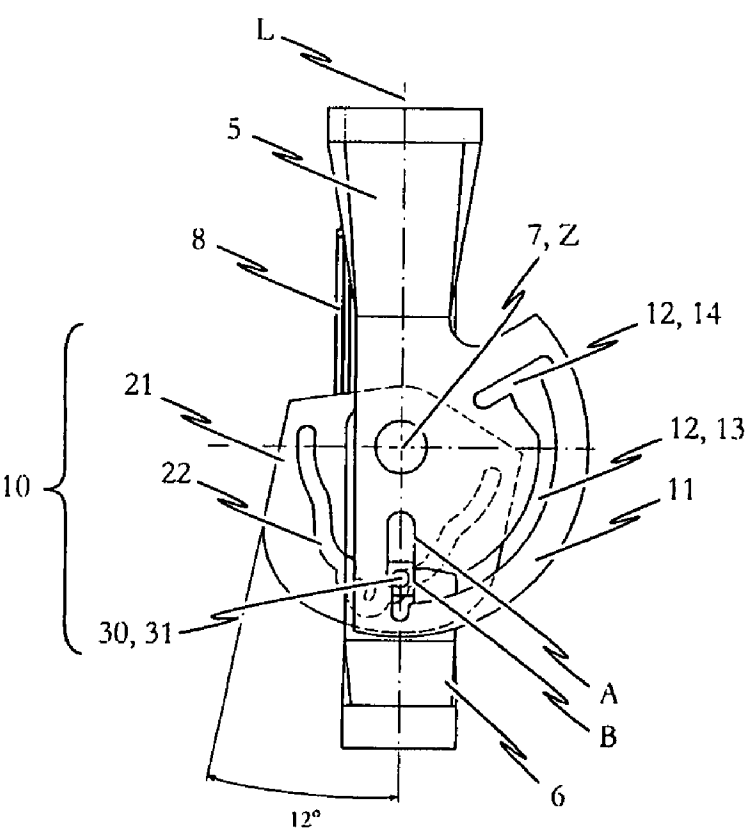
FIG. 2*b* a top plan view of the pivoting mechanism according to FIG. 2*a* in an unlocked and outwardly-pivoted state of both shaft components.
Figure 2A:
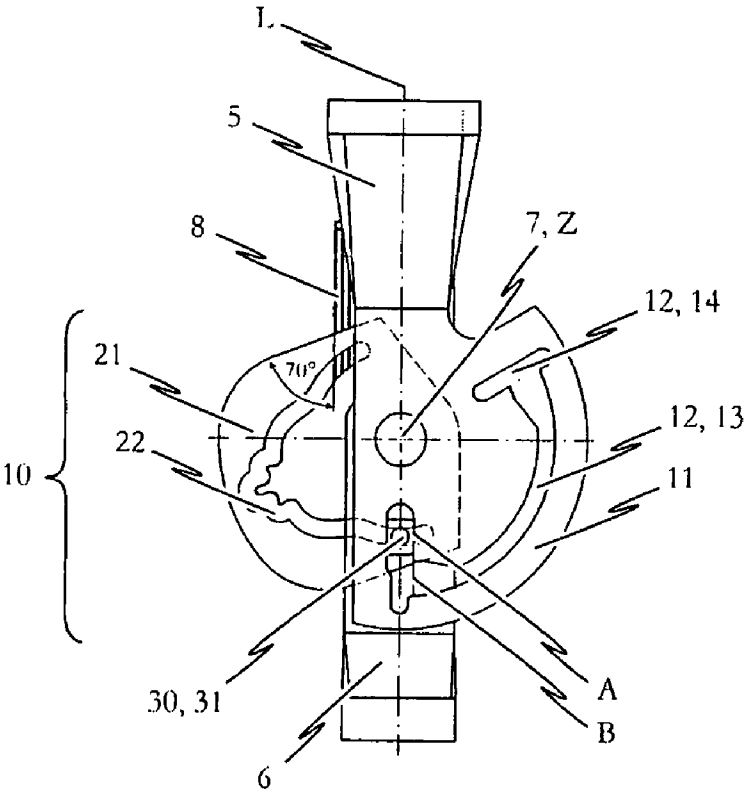
FIG. 2*a* a top plan view of the pivoting mechanism employed in the central buffer coupling shown in FIG. 1 in a locked and outwardly-pivoted state of both shaft components.

In detail, FIG. 2*a* shows a top plan view of the pivoting mechanism 10 employed in the central buffer coupling 1 shown in FIG. 1 in a locked and outwardly-pivoted state of the two shaft components 5, 6 of coupling shaft 3. To be recognized from this is that the cam disc guide 22 on the one hand and the sliding guide 12 on the other interact such that they align at exactly the point where bolt 30 is disposed. This point, at which the bolt 30 is disposed, is located in the first position A, in which the two shaft components 5, 6 are thus not pivotable relative one another. Specifically, the first end of the bolt guide 31 of bolt 30 associated with sliding guide 12 is located in the latching section 14 of the sliding guide 12.

FIG. 2*b* shows a top plan view depicting the pivoting mechanism 10 according to FIG. 2*a* in an unlocked state of the two shaft components 5, 6. In contrast to FIG. 2*a*, the state of the cam disc 21 shown in FIG. 2*b* is rotated 58° about the rotational axis Z defined by the connecting pin 7. This rotating or pivoting of the cam disc 21 relative to the front and rear shaft components 5, 6 causes the bolt 30 to move from position A (cf. FIG. 2*a*) into position B. As indicated above, this can be realized when the bolt 30 is for example configured in the rear shaft component 6 and held in a slot extending in the longitudinal direction of coupling shaft 3. The resultant play for bolt 30 in the longitudinal direction of coupling shaft 3 should thereby be greater or at least equal to the length of latching section 14 of sliding guide 12.

Figure 2D:
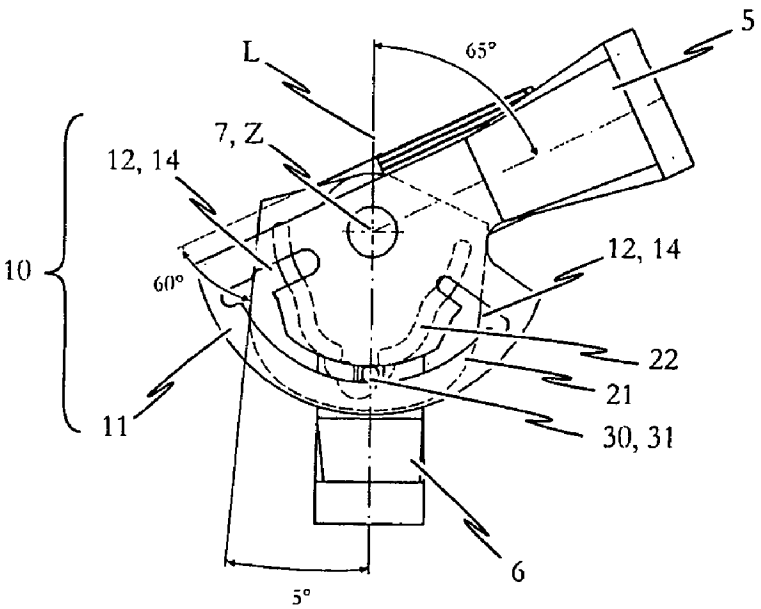
FIG. 2*d* a top plan view of the pivoting mechanism according to FIG. 2*a* in an unlocked state and the two shaft components pivoted by 65°.
Figure 2C:
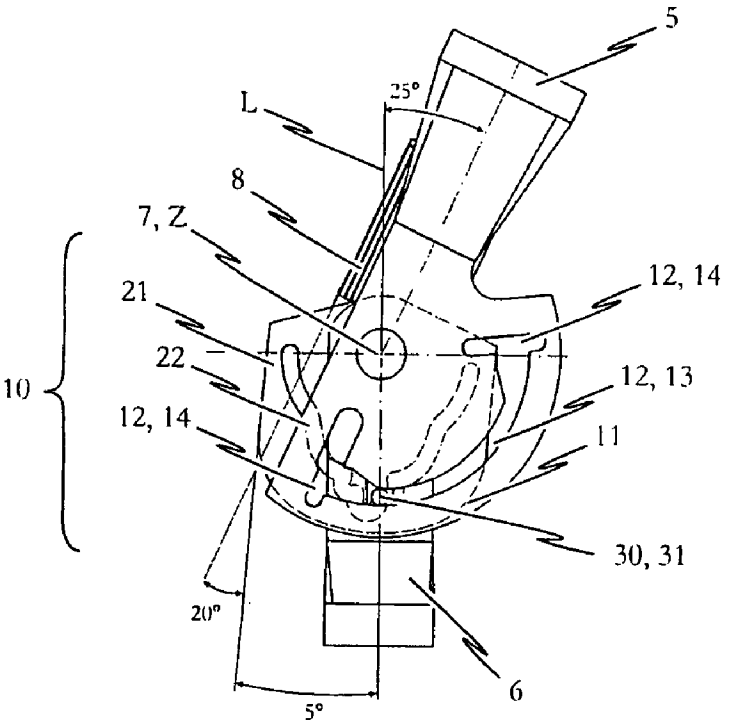
FIG. 2*c* a top plan view of the pivoting mechanism according to FIG. 2*a* in an unlocked state and the two shaft components pivoted by 25°.

FIG. 2*c* shows a top plan view depicting the pivoting mechanism according to FIG. 2*a* or FIG. 2*b* in an unlocked state of the two shaft components 5, 6 and pivoted 25°. This 25° pivoting of the two shaft components 5, 6 relative one another is effected by the cam disc 21 being rotated further about the rotational axis Z. In comparison to the state depicted in FIG. 2*b*, the state of cam disc 21 shown in FIG. 2*c* is rotated by a further 7°. With this further rotation of cam disc 21, the first end of the bolt guide 31 of bolt 30 delegated to slotted gate 11 enters the circular-segmented guiding section 13 of the sliding guide 12 on the one hand while, on the other, the (not explicitly shown) second end of the bolt guide 31 of bolt 31 delegated to the cam disc 21 reaches the cam disc guide 22 on the first pivot section 25 provided in crown section 24.

FIG. 2*d* shows a top plan view depicting the pivoting mechanism 10 according to FIG. 2*a* in an unlocked state of the two shaft components 5, 6 and pivoted 65°. In comparison to the state depicted in FIG. 2*c*, the state of cam disc 21 shown in FIG. 2*d* has not been rotated any further; instead the cam disc 21 of the front shaft component 5 can be further pivoted relative the rear shaft component 6 without a further rotation, since the second end of the bolt guide 31 of bolt 30 delegated to the cam disc 21 is already within the pivot section 25 of the cam disc guide 22. The second end of the bolt guide 31 of bolt 30 therefore remains in the pivot section 25 of cam disc 21, while the first end of the bolt guide 31 of bolt 30 delegated to the slotted gate 11, however, travels further into the guide section 13 of sliding guide 12.

Figure 2F:
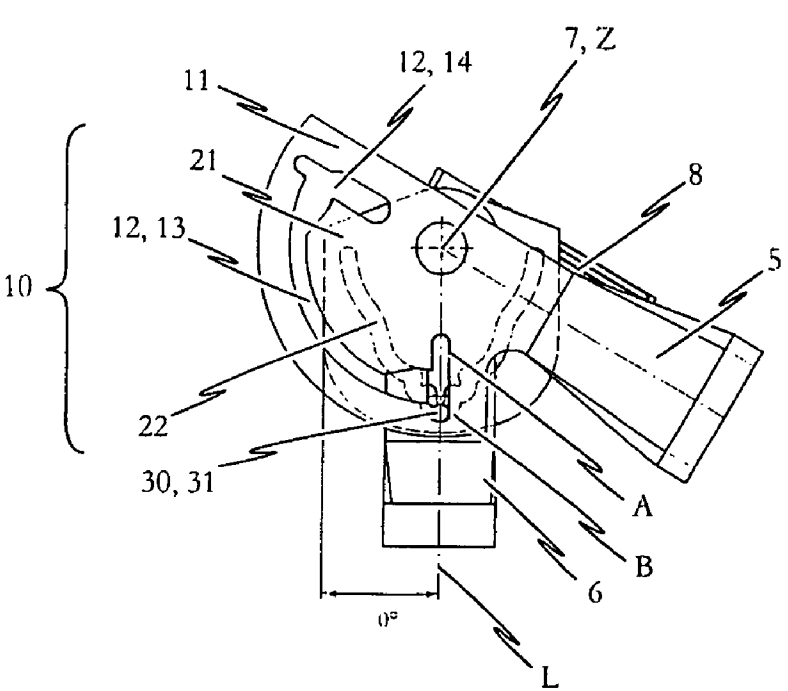
FIG. 2*f* a top plan view of the pivoting mechanism according to FIG. 2*e* as the bolt transitions from the circular-segmented guide section of the slotted gate into the associated latching section.
Figure 2E:
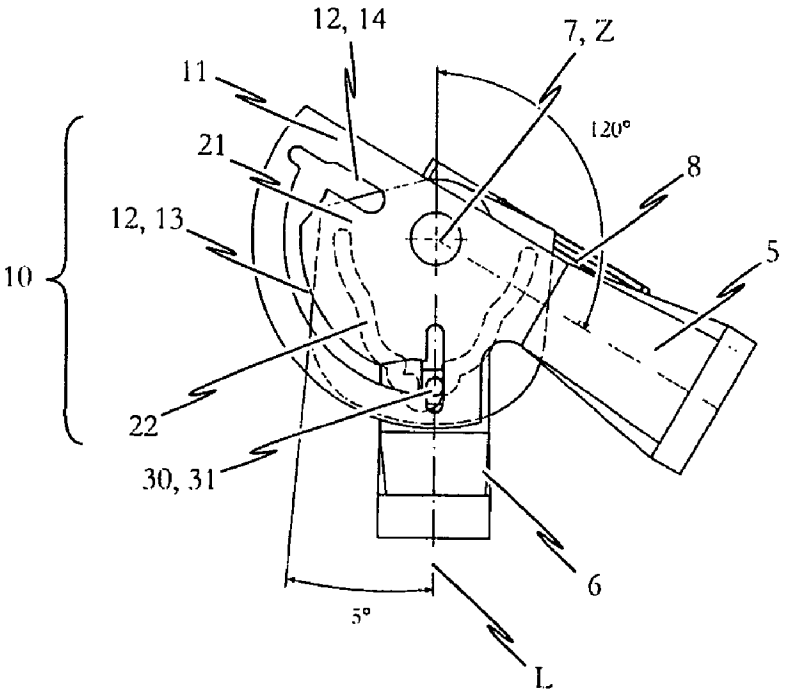
FIG. 2*e* a top plan view of the pivoting mechanism according to FIG. 2*a* in an unlocked state and the two shaft components pivoted by 120°.

FIG. 2*e* likewise shows a top plan view of the pivoting mechanism 10 in a state in which the first end of the bolt guide 31 of bolt 30 delegated to the slotted gate 11 is moved to the outer end of the guide section 13 of the slotted gate 11. Since a further pivoting of the two shaft components 5, 6 relative one another is no longer possible in the state shown in FIG. 2*e*, the further progression is the locking of the two shaft components 5, 6 relative to one another, which will be clarified by drawing reference to FIGS. 2*f* to 2*h* as described below.

FIG. 2*f* depicts a state in which the first end of the bolt guide 31 of bolt 30 has entered the latching section 14 of slotted gate 11, although the bolt 30 is still in the unlocked position B. On the other hand, the second end of the bolt guide 31 of bolt 30 delegated to the cam disc 21 is now conveyed from the pivot section 25 into the crown section 24 by the further 5° rotation of the cam disc 21 relative to the rear shaft component 6.

Figure 2H:
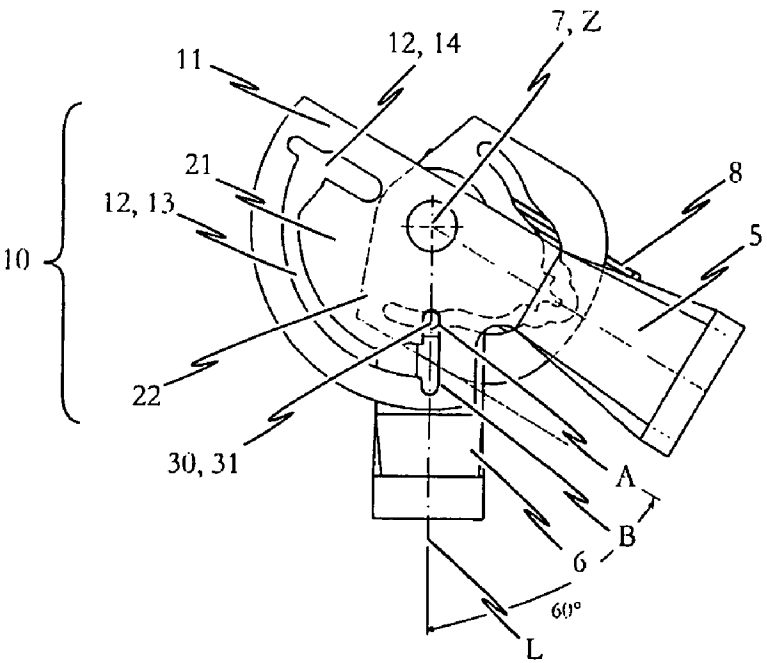
FIG. 2*h* a top plan view of the pivoting mechanism according to FIG. 2*a* in an inwardly-pivoted and locked state of both shaft components.
Figure 2G:
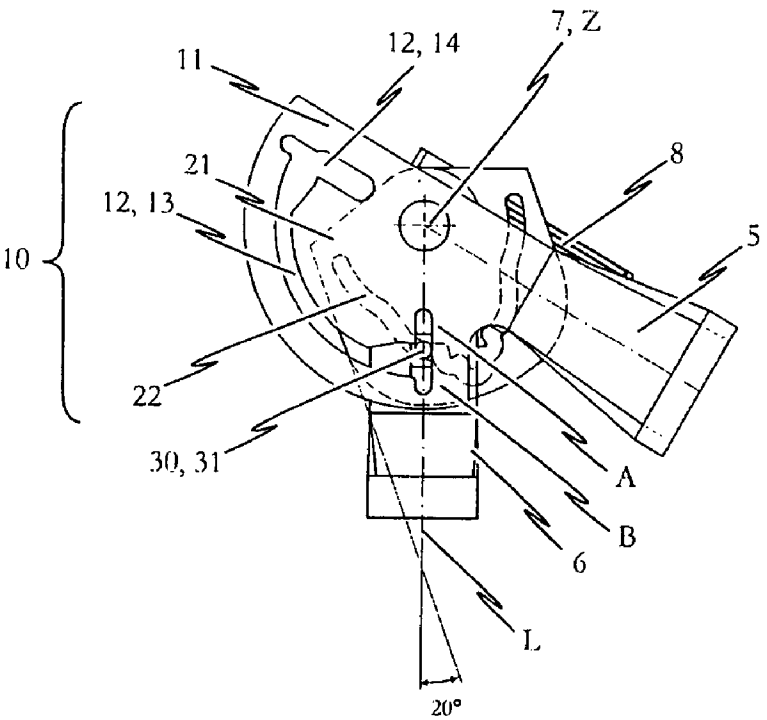
FIG. 2*g* a top plan view of the pivoting mechanism according to FIG. 2*f* as the bolt transitions from the circular-segmented guide section of the slotted gate into the associated latching section.

FIG. 2*g* depicts a state in which the cam disc 21 is pivoted a further 20° about the rotational axis Z relative the state depicted in FIG. 2*f*. While this rotation does not effect a further pivoting of the two shaft components 5, 6 relative one another, the shape of the cam disc guide 22 does, however, now guide the bolt 30 in the direction of position A of the latching section 14 of slotted gate 11.

FIG. 2*h* shows a top plan view of the pivoting mechanism 10 in an inward-pivoted and locked state of the two shaft components 5, 6. In contrast to the state depicted in FIG. 2*g*, the state of cam disc 21 shown in FIG. 2*h* is pivoted a further 40° about rotational axis Z, in consequence of which the first end of the bolt guide 31 of bolt 30 is moved further into position A, so that a locked state of the two shaft components 5, 6 relative one another ensues.

Based on the above described functioning of the pivoting mechanism 10 employed in the preferred embodiment of the central buffer coupling 1, it is evident that the guide section 13 of the slotted gate 11 defines the pivotable range of the two shaft components 5, 6 relative one another. As the guide section 13 covers a larger or smaller circular-segmented section, the attainable angle of articulation can be predefined.

The invention is not limited to the specific embodiments of the cam disc and/or the slotted gate of the pivoting mechanism as depicted in the figures. In fact, other designs are also suited to the guides provided in the slotted gate and/or cam disc. For example, a joint consisting of fork and eye is also conceivable, and the cam disc 21 can also be disposed for example above the slotted gate 11. Moreover, the pivoting mechanism 10 and the coupling shaft 3 can also be fit into the coupling with its two shaft components 5, 6 rotated 180° about Z. Lastly, instead of two slotted gates 11, 32, only one slotted gate can also be implemented.

The invention claimed is:

1. A central buffer coupling having a coupling head, a coupling shaft and a bearing block attachable to the front face of a car body, wherein the coupling shaft comprises a front shaft component supporting the coupling head and a rear shaft component coupled to the bearing block so as to be horizontally pivotable which are pivotable in the horizontal plane relative one another about an axis of rotation defined by a connecting pin, and wherein the central buffer coupling further comprises a pivoting mechanism for pivoting the front shaft component relative the rear shaft component, wherein the pivoting mechanism comprises a slotted gate fixedly attached to one of the front shaft component and the rear shaft component, and having a sliding guide, a cam disc rotatably mounted about the rotational axis defined by the connecting pin and having a cam disc guide, and a bolt connecting the one to the other of the front shaft component and the rear shaft component, the first end of which is received in a bolt guide in the sliding guide and its second end in the bolt guide in the cam disc guide in each case such that upon rotation of the cam disc about the rotational axis, at least a portion of the resulting torque can be transmitted from the cam disc to the slotted gate via the bolt, wherein each rotational position of the cam disc corresponds to a specific position of the first end of the bolt guide of the bolt delegated to the slotted gate in the sliding guide, wherein the sliding guide of the slotted gate comprises a uniform circular-segmented guiding section which—depending on the position of the first end of the bolt guide of the bolt delegated to the slotted gate within the circular-segmented guiding section—defines the angle of articulation for the front shaft component relative the rear shaft component, and wherein the bolt is displaceable along the longitudinal axis of the coupling shaft relative to the rear shaft component, between a first position, in which the two shaft components are not pivotable relative one another, and a second position, in which the two shaft components are pivotable relative one another, and wherein the sliding guide of the slotted gate exhibits at least one latching section configured on one of the two ends of the circular-segmented guiding section which blocks or enables access for the first end of the bolt guide of the bolt associated with the slotted gate in the circular-segmented guiding section depending on the position of the bolt on the longitudinal axis of the coupling shaft.

2. The central buffer coupling according to claim 1, wherein the sliding guide of the slotted gate and/or the cam disc guide of the cam disc is configured as a guiding slot in which the respectively delegated end of the bolt guide of the bolt is received.

3. The central buffer coupling according to claim 2, wherein the sliding guide of the slotted gate and/or the cam disc guide of the cam disc is configured as a guiding groove in which the respectively delegated end of the bolt guide of the bolt is received.

4. The central buffer coupling according to claim 2, wherein the pivoting mechanism further comprises an actuatable drive disposed on one of the front shaft component and the rear shaft component, so as to be substantially immovable relative to said one of the two shaft components and is designed to rotate as needed the cam disc relative the other of the front shaft component and the rear shaft component, about the rotational axis defined by the connecting pin.

5. The central buffer coupling according to claim 4, wherein the connecting pin extends through the cam disc and is fixedly connected to same, and wherein the drive is designed to rotate the connecting pin about the rotational axis as needed and thus actuate the cam disc.

6. The central buffer coupling according to claim 1, wherein the sliding guide of the slotted gate and/or the cam disc guide of the cam disc is configured as a guiding groove in which the respectively delegated end of the bolt guide of the bolt is received.

7. The central buffer coupling according to claim 6, wherein the pivoting mechanism further comprises an actuatable drive disposed on one of the front shaft component and rear shaft component, so as to be substantially immovable relative to said one of the two shaft components and is designed to rotate as needed the cam disc relative the other of the front shaft component and the rear shaft component, about the rotational axis defined by the connecting pin.

8. The central buffer coupling according to claim 7, wherein the connecting pin extends through the cam disc and is fixedly connected to same, and wherein the drive is designed to rotate the connecting pin about the rotational axis as needed and thus actuate the cam disc.

9. The central buffer coupling according to claim 1, wherein the pivoting mechanism further comprises an actuatable drive disposed on one of the front shaft component and the rear shaft component, so as to be substantially immovable relative to said one of the two shaft components and is designed to rotate as needed the cam disc relative the other of the front shaft component and the rear shaft component, about the rotational axis defined by the connecting pin.

10. The central buffer coupling according to claim 9, wherein the connecting pin extends through the cam disc and is fixedly connected to same, and wherein the drive is designed to rotate the connecting pin about the rotational axis as needed and thus actuate the cam disc.

11. The central buffer coupling according to claim 1, wherein the front shaft component and the rear shaft component are each configured as a fork with two respective fork arms, wherein the two fork arms of the rear shaft component, are at least partly received between the fork arms of the front shaft component, wherein the cam disc is at least partly received between the two fork arms of the front shaft component, and wherein the connecting pin extends through the two fork arms of the front shaft component and is pivotably supported about the rotational axis both in the fork arms of the rear shaft component as well as in the fork arms of the front shaft component.

12. The central buffer coupling according to any one of claims 1 to 11, wherein the bolt is preferably fixedly connected on the longitudinal axis of the coupling shaft to the rear shaft component.

13. The central buffer coupling according to claim 1, wherein the bolt is configured in the other of the two shaft components, for example the rear shaft component, and held in a slot preferably extending in the longitudinal direction of the coupling shaft, wherein the resultant play for the bolt is greater or equal to the length of the latching section of the sliding guide.

14. The central buffer coupling according to claim 13, wherein the cam disc guide preferably exhibits a symmetrical, substantially U-shaped or V-shaped design having two limb sections and a crown section situated between said two limb sections, wherein the cam disc guide and the sliding guide interact such that when the bolt is moved between the first and the second position, the first end of the bolt guide of the bolt engages on the one hand in one of the two latching sections of the sliding guide and the second end of the bolt guide of the bolt engages in one of the limb sections of the cam disc guide on the other, and that when the front shaft component is moved relative to the rear shaft component, the first end of the bolt guide of the bolt engages on the one hand in the circular-segmented guide section of the sliding guide and the second end of the bolt guide of the bolt engages on the other in the crown section of the cam disc guide.

15. The central buffer coupling according to claim 14, wherein the cam disc guide comprises two pivot sections situated in the crown section, wherein the cam disc guide and the sliding guide interact such that when the second end of the bolt guide of the bolt engages in one of the two pivot sections, the first end of the bolt guide of the bolt is displaceable relative the circular-segmented guide section of the sliding guide.

16. The central buffer coupling according to claim 1, wherein the cam disc guide preferably exhibits a symmetrical, substantially U-shaped or V-shaped design having two limb sections and a crown section situated between said two limb sections, wherein the cam disc guide and the sliding guide interact such that when the bolt is moved between the first and the second position, the first end of the bolt guide of the bolt engages on the one hand in one of the two latching sections of the sliding guide and the second end of the bolt guide of the bolt engages in one of the limb sections of the cam disc guide on the other, and that when the front shaft component is moved relative to the rear shaft component, the first end of the bolt guide of the bolt engages on the one hand in the circular-segmented guide section of the sliding guide and the second end of the bolt guide of the bolt engages on the other in the crown section of the cam disc guide.

17. The central buffer coupling according to claim 16, wherein the cam disc guide comprises two pivot sections situated in the crown section, wherein the cam disc guide and the sliding guide interact such that when the second end of the bolt guide of the bolt engages in one of the two pivot sections, the first end of the bolt guide of the bolt is displaceable relative the circular-segmented guide section of the sliding guide.

18. The central buffer coupling according to claim 1, wherein the slotted gate is releasably attached to the front shaft component.

* * * * *